US006527127B2

(12) United States Patent
Dumontet

(10) Patent No.: US 6,527,127 B2
(45) Date of Patent: Mar. 4, 2003

(54) UNIVERSAL SHELVING

(75) Inventor: Ronald Dumontet, Sherbrooke (CA)

(73) Assignee: Tablex Inc., Sherbrooke (CA)

( * ) Notice: Subject to any disclaimer, the term of this patent is extended or adjusted under 35 U.S.C. 154(b) by 0 days.

(21) Appl. No.: 09/921,572

(22) Filed: Aug. 6, 2001

(65) Prior Publication Data

US 2003/0024889 A1 Feb. 6, 2003

(51) Int. Cl.[7] ..... A47F 5/00
(52) U.S. Cl. ..... 211/59.3; 211/184; 312/71
(58) Field of Search ..... 211/59.3, 59.2, 211/184; 312/61, 71, 42

(56) References Cited

U.S. PATENT DOCUMENTS

| | | | | | |
|---|---|---|---|---|---|
| 2,111,496 | A | | 3/1938 | Scriba | 211/49 |
| 2,308,851 | A | | 1/1943 | Anderson | 211/49 |
| 2,652,154 | A | | 9/1953 | Stevens | 211/49 |
| 2,934,212 | A | | 4/1960 | Jacobson | 211/49 |
| 2,980,259 | A | * | 4/1961 | Fowlds | |
| 3,161,295 | A | | 12/1964 | Chesley | 211/49 |
| 3,308,961 | A | | 3/1967 | Chesley | 211/49 |
| 3,570,680 | A | * | 3/1971 | Klassen | |
| 4,042,098 | A | | 8/1977 | Smith | 211/49 |
| 4,119,208 | A | | 10/1978 | Acker | 211/49 |
| 4,300,693 | A | | 11/1981 | Spamer | 211/49 |
| 4,762,236 | A | | 8/1988 | Jackle, III et al. | 211/59.3 |
| 4,830,201 | A | | 5/1989 | Breslow | 211/184 |
| 4,899,893 | A | | 2/1990 | Robertson | 211/59.3 |
| 4,901,869 | A | | 2/1990 | Hawkinsson et al. | 211/59.3 |
| 4,907,707 | A | | 3/1990 | Crum | 211/59.3 |
| 5,190,186 | A | * | 3/1993 | Yablans | |
| 5,203,463 | A | | 4/1993 | Gold | 211/59.3 |
| 5,413,229 | A | | 5/1995 | Zuberbuhler et al. | 211/59.3 |
| 5,469,978 | A | | 11/1995 | Burchell | 211/59.3 |
| 5,638,963 | A | | 6/1997 | Finelly et al. | 211/59.3 |
| 5,878,895 | A | | 3/1999 | Springs | 211/59.3 |
| 6,227,385 | B1 | * | 5/2001 | Nickerson | 211/59.3 |
| 6,382,431 | B1 | * | 5/2002 | Banke | 211/59.3 |

FOREIGN PATENT DOCUMENTS

| | | | |
|---|---|---|---|
| CA | 2233761 | 11/1999 | A47F/3/00 |

* cited by examiner

*Primary Examiner*—Robert W. Gibson, Jr.
(74) *Attorney, Agent, or Firm*—Robic

(57) ABSTRACT

A device for moving forward in an easy and efficient manner, articles such as canned goods, that are placed on a store shelf in order to facilitate their frontal display. The device makes use of positioning rods that are installed on the shelf so as to extend in parallel relationship with respect to the edge of the shelf. Two parallel side rails act as a support for the articles. These side rails extend on both sides of a central rail supporting a puller member and a backstop assembly. The side rails and the central rail are perpendicular to the edge of the shelf and are detachably fastened to the positioning rods, preferably by snapping. As a result, one may easily adjust their spacing as a function of the size of the articles. The backstop assembly is located at the back end of the puller member. It extends vertically and moves the articles closer to the front of the shelf when the puller member is pulled forward.

19 Claims, 12 Drawing Sheets

UNIVERSAL SHELVING

FIELD OF THE INVENTION

The present invention relates to a device hereinafter called "universal shelving", which is designed to facilitate the positioning of articles displayed on a store shelf. This device permits to move the articles closer to the front edge of the shelf and thus to ensure frontal display of the articles in an easy and efficient manner.

BACKGROUND INFORMATION

In retail stores, it is desirable that the articles displayed on shelves extend near the front edges of the shelves, because such gives an impression of cleanliness and order. Frontal display is also desirable for the consumer since she/he does not have to reach to the back of the shelf to pick up the desired article, in the case where the other articles placed in front of it have already been picked up. Such a frontal display may in fact allow the store owner to increase his/her sales by displaying the articles in a more desirable fashion. Such a frontal display also allows the consumer to have quicker and easier access to the article labels and thus to shop more pleasantly.

However, to maintain such a frontal display requires a great deal of time from grocery clerks. Moreover, many articles may be broken or damaged when the articles are repositioned to the front of the shelf.

Many attempts have been made to solve the above problem.

U.S. Pat. No. 5,638,963 describes a display device comprising a puller member for use to bring articles toward the front of a shelf. The device also comprises a base plate provided with slits in which T-shaped rods are inserted. The puller member as well as the partitions are mounted between these T-shaped rods which also hold them in place. This device seems efficient, but it lacks flexibility with regards to the adjustment of the partitions and puller member to ensure that the device extends to the maximum extent, over the length of the shelves. The partitions in the device can only be positioned at distances that are predetermined by the positions of the slits on the base plate. As a result, the articles placed on the shelf are not necessarily packed tightly between the partitions and the shelf may then contain fewer rows of articles because of the loss of space between the rows. This loss of space on the shelf can result in a decrease in sales and thus, in financial losses. The device also requires a large number of pieces to assemble it. Indeed, in addition to the required base plate, puller member, backstop assembly and partitions, a minimum of eight (8) T-shaped rods are required to properly assemble and use the device. The necessity of having eight (8) rods to install each row of articles makes the assembly of the device time consuming and also more susceptible to have pieces break during assembly or use.

U.S. Pat. No. 4,901,869 describes a display device which comprises a base, a puller member, a backstop assembly, partitions and connecting means to connect all the pieces together. The base and the partitions are made of plates having a number of parallel back-to-back V-grooves. The grooves are devised to allow easy breakage of the plates in order to obtain the desired dimension thus forming the base and partitions of the device. To assemble the device, the plates are sized (i.e. broken) in order to properly receive the articles to be placed. In use, one cannot adjust the size of the base plate without having to break the plates along the V-grooves. After a first use, the plates whose dimensions have been modified by breakage can now only be used for articles of the same or of a smaller size. Obviously, this limits the possibility of modifications of the display by a merchant. Moreover, the device is tedious to modify since each plate has two sides inserted in the connecting means which hold the plates, the puller member and the partitions together. Therefore, to modify the width of a row, the plates must be detached from their respective connectors, broken to the right size, and then reinserted into their connectors in order to maintain the symmetry of the device.

U.S. Pat. No. 5,469,976 describes an article display device comprising side rails used to support the articles to be displayed, base rails serving to support the side rails and a puller member used to bring the articles toward the front of the shelf. The patent mentions materials that can be used as means to connect the side rails to the base rails. More specifically, it mentions Velcro™, double-sided tape and non-permanent adhesives. Those materials are interesting. However, after multiple adjustments, they may lose their strength and efficiency, thereby affecting the stability of the entire device. Also, the puller member is not stabilized within the device and is therefore free to move around, which can make the device difficult to use.

U.S. Pat. No. 5,413,229 describes a display device similar to the one disclosed in U.S. Pat. No. 5,469,976. The connecting means disclosed in U.S. Pat. No. 5,413,229 for use to connect the side rails and the base rails consist of Velcro™. Once again, wear and tear after repeated use, leads to a loss of strength and efficiency of said connecting means and thus a loss of stability of the entire device. Moreover, the device has a puller member made of a rod which is not stabilized within the device and which may be displaced from the central axis, and thus can make the device difficult to use.

Applicant's Canadian laid-open patent application No. CA 2,233,761 describes a display device comprising two side rails acting as support for the articles to be displayed and a backstop assembly fastened to the back end of the puller member. The puller member is placed between the two side rails which are previously individually fastened on the shelf. The width of the puller member determines the width between the two side rails and therefore the size of the products which may be placed on the rails. This device is very simple because it only requires to pull a puller member in order to bring forward the articles. However, it is not adaptable to articles of different sizes. Moreover, the side rails are very bulky and thus, do not permit to obtain a maximum number of rows of articles on each shelf. This leads retailers to lose a considerable amount of display space.

SUMMARY OF THE INVENTION

A first object of the present invention is to provide a display device of an improved structure to move forward articles placed on a shelf in a simple and efficient manner, in order to facilitate their frontal display.

A second object of the invention is to provide a device whose dimensions may be easily and rapidly modified to allow display of articles of dimensions completely different from those of articles previously displayed, thereby reducing to a minimum extent the loss of space on the shelf.

The device according to the invention fulfills these two objects, in that it allows the frontal display in an easy and efficient manner of the articles placed on a shelf, and it also permits to modify the width of the rows easily and rapidly in order to display articles of dimensions completely different from those of articles previously displayed.

The device according to the invention comprises positioning means, preferably consisting of rigid rods, which are installed on the shelf so as to extend in parallel relationship with respect to the front edge of the shelf. The device also comprises two parallel side rails acting as a support for the articles, a central rail, a puller member and a backstop assembly. Each of the side rails comprises a top side, a bottom side, two lateral sides, a front end, a back end and fastening means, such as notches, for connecting the side rails on the positioning means in such a way that they extend perpendicularly to the front edge of the shelf. The central rail comprises a top side, a bottom side, a front end, a back end, two lateral sides, and fastening means such as notches, for connecting the central rail on the positioning means between the two side rails in a parallel relationship with respect thereto. The puller member is mounted onto the central rail in such a way as to extend in parallel relationship with respect to the side rails. The puller member has a front end and a back end. The backstop assembly is located at the back end of the puller member. It extends vertically and is designed to move the articles placed on the top side of the side rails and in front of the backstop assembly toward the front end of the side rails when the puller member is pulled.

The device according to the invention is attractive inasmuch as it permits to move forward articles placed on a shelf in a simple and efficient manner. Thanks to its improved structure, one may use to a maximum extent the space of the shelf for displaying articles. The device according to the invention is also attractive inasmuch as it is easily adjustable thanks to its fastening means, which allows fast modification of the display device as a function of the dimensions of the articles to be displayed.

According to a preferred embodiment of the invention, partitions which are preferably extremely thin, are provided to retain the articles on the side rails and to guide them. These partitions can be attached on the lateral sides of the side rails which are the farthest from the central rail. The side rails are advantageously designed to receive partitions on either side of the rails. Such makes these side rails interchangeable and thus reduces the number of different pieces necessary for assembling the device. All the side rails, whatever be their final position, are actually identical.

The invention and its operation will be better understood upon reading the non limitative description which follows of a preferred embodiment thereof and of some variants of this preferred embodiment, said following description being made with reference to the accompanying drawings.

DETAILED DESCRIPTION OF THE INVENTION

Figure 1:
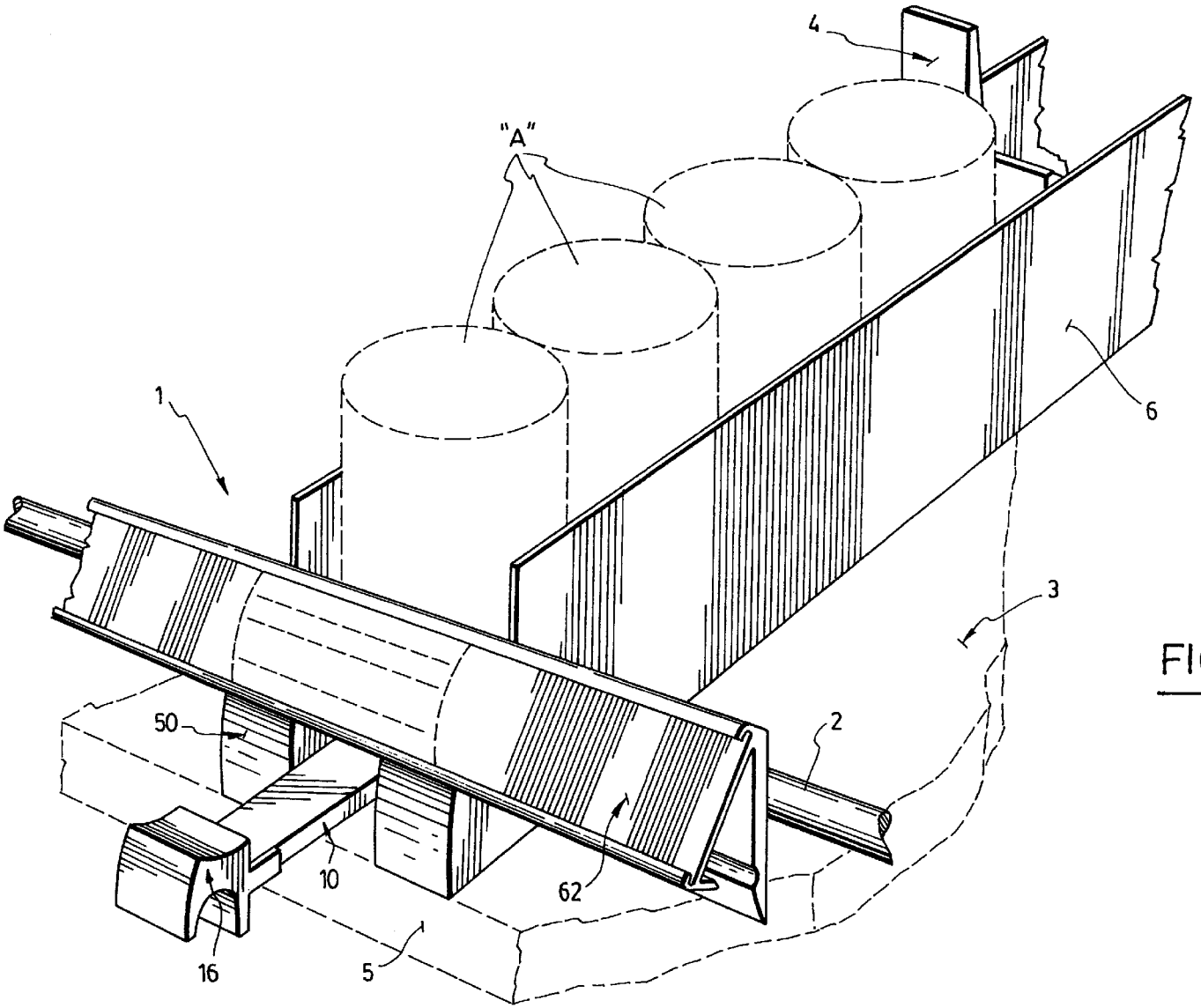
FIG. 1 is a perspective view of a device according to a preferred embodiment of the invention, said device being installed on a shelf and supporting canned goods of cylindrical shape as articles to be displayed.
Figure 3:
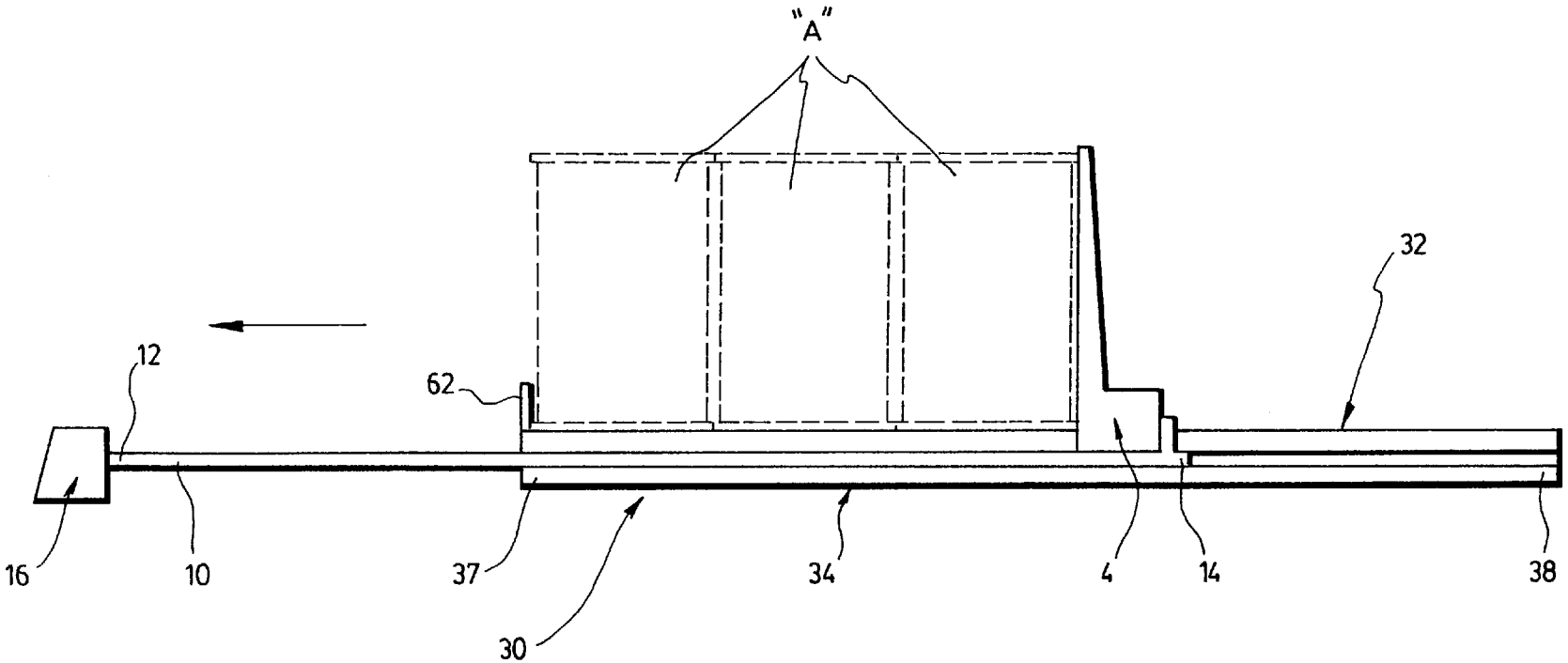
FIG. 3 is a cross-sectional side view of the central rail of the device, showing how the puller member can be pulled toward the front of the rail to bring forward the articles.
Figure 7:
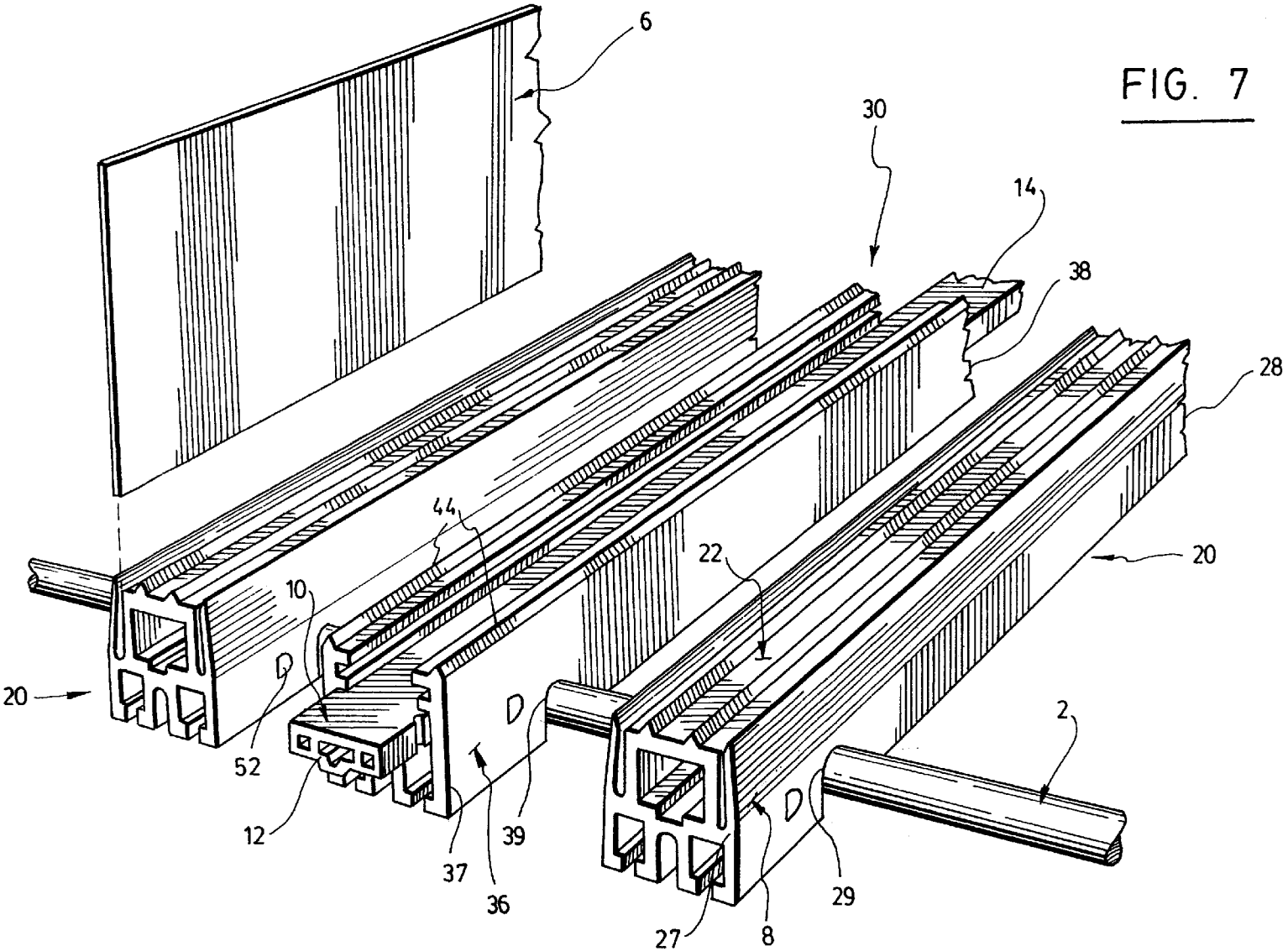
FIG. 7 is a semi-exploded perspective view of the elements illustrated in FIG. 6.

The device (1) according to the preferred embodiment of the invention as shown in FIGS. 1, 3 and 7, is designed to move forward, in a simple yet efficient manner, articles (A) of given dimensions placed on a shelf (3) provided with a front edge (5), and thus to facilitate frontal display of these articles (A). In the preferred embodiment that is illustrated, the articles (A) are canned goods of cylindrical shape. These articles (A) could also be of many different forms such as square, rectangular, etc.

The device (1) comprises as basic elements:

positioning means installed on a shelf (3) in such a way as to extend in parallel relationship to the front edge (5) of this shelf (3);

two side rails (20);

a central rail (30);

a puller member (10); and a backstop assembly (4).

The two side rails (20) act as a support for the articles (A). As better illustrated in FIGS. 2 and 6, each of the side rails (20) comprise: a top side (22), a bottom side (24), two lateral sides (26), a front end (27), a back end (28) and fastening means for connecting the side rail (20) on the positioning means at any distance away from the other side rail (20) depending on the size of the articles (A). The side rails (20), once installed, extend in parallel relationship perpendicularly to the front edge (5) of the shelf (3).

The central rail (30) comprises a bottom side (34) in contact with the shelf (3), a top side (32), two lateral sides (36), a front end (37), a back end (38) and fastening means for connecting the central rail (30) on the positioning means between the two side rails (20) in parallel relationship with respect thereto.

The puller member (10) is mounted in such a way as to slide on the central rail (30). The puller member has a front end (12) and a back end (14).

As better illustrated in FIG. 3, the backstop assembly (4) is mounted in such a way as to slide on the central rail (30). This backstop assembly (4) is located at the back end (14) of the puller member (10), where it extends vertically. It is intended to be used to move forward the articles (A) toward the front ends (27) of the side rails (20) with the help of the puller member (10) when the articles (A) are placed in front of the backstop assembly (4) on the top side (32) of the central rail (30).

Figure 2:
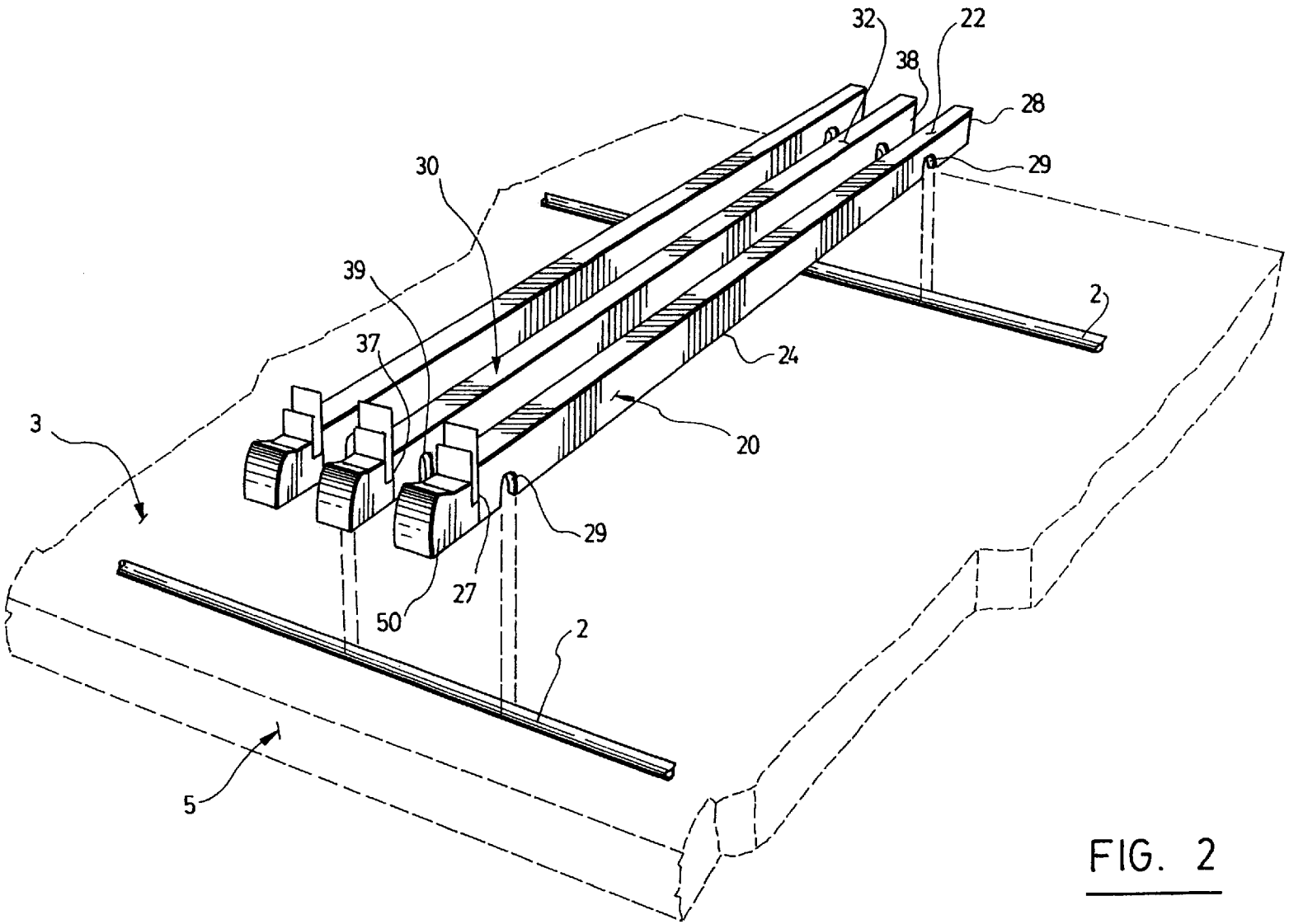
FIG. 2 is a perspective view of the rods acting as positioning means and of the side and central rails of the device illustrated in FIG. 1, before these elements are connected together.

Referring to FIG. 2, the fastening means located on the side rails (20) and the central rail (30) preferably consist of notches (29, 39) shaped and sized to allow connection of the rails (20, 30) onto the positioning means, which preferably consist of at least one rod (2) that extends in parallel relationship with respect to the front edge (5) of the shelf (3). Preferably, the side rails (20) and the central rail (30) are connected by snapping of the notches (29, 39) to the rod (2).

As better illustrated in FIG. 2, the positioning means preferably comprise two rods (2) that extend in parallel relationship with respect to the front edge (5) of the shelf (3). Preferably also, the notches (29, 39) used to fasten the side rails (20) and central rail (30) to the rods (2) are located onto the lower sides (24, 34) of said rails (20, 30). The rods (2) preferably comprise a rigid core made of plastic material, metal or wood, that is surrounded by a sleeve of softer material, such as a rubber-like material or any other material exhibiting similar characteristics.

Other types of positioning means and fastening means could also be used provided that they are compatible with each other to allow the connection of the rails at any distance from one another. For example, a rod could be used on which the rails would be slid from the front of the shelf toward the back of the same for snapping into position. In this case, the rails would comprise a strip located underneath which would connect with the rods specially made to receive them. Use could also be made of a rod located near the front of the shelf on which the rails would be connected thanks to a fastening means of the clip-type. It should be noted that in all cases, it is compulsory that rails be easily fastenable to the positioning means and be easy to move in order to modify the dimensions of the device to accommodate articles of different sizes.

Figure 6:
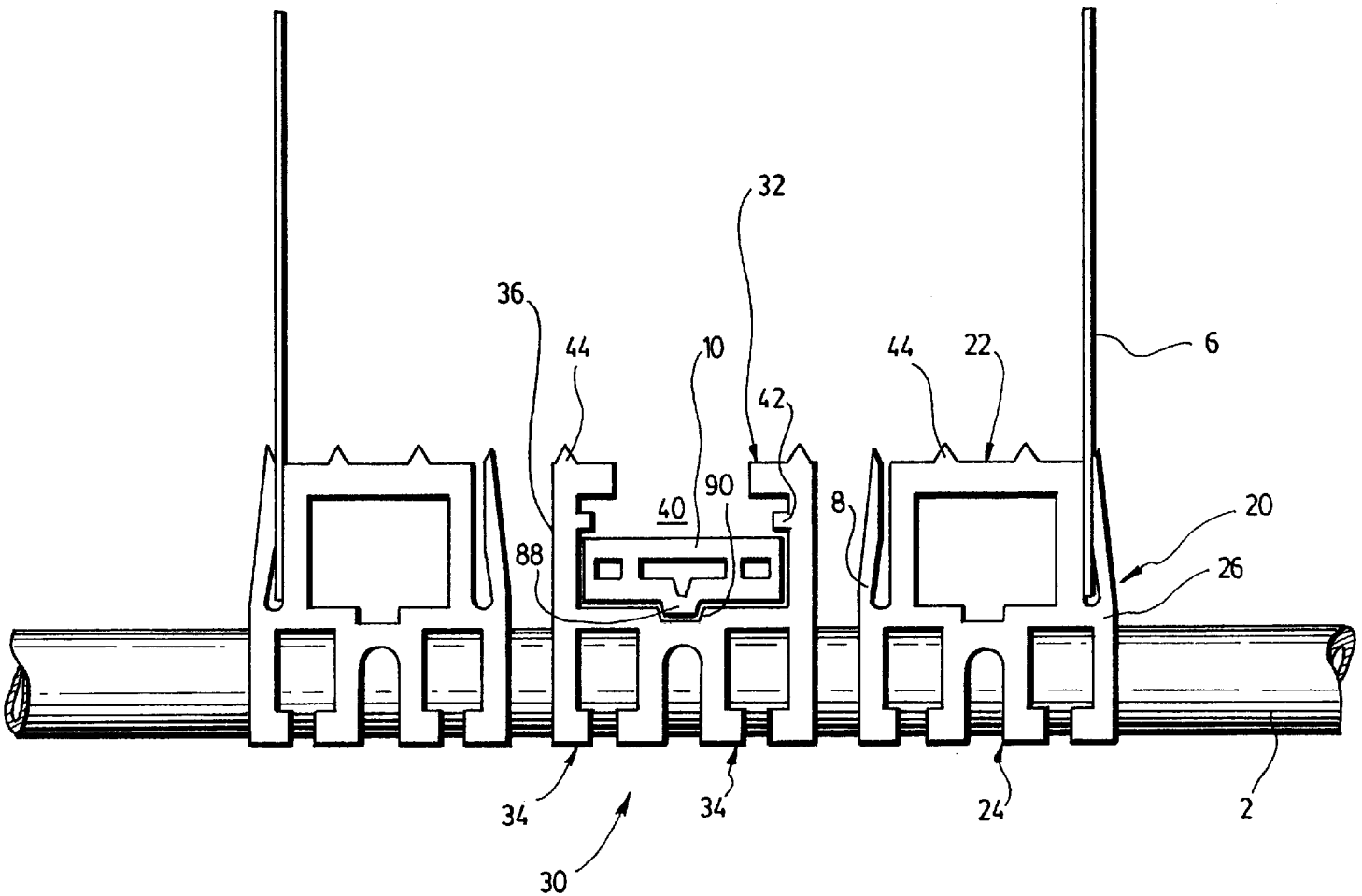
FIG. 6 is a cross-sectional front view of the device showing the assembly of the side and central rails on one of the two positioning rods, the side rails supporting the partitions and the central rail containing the puller member inside its upper part.

As better illustrated in FIGS. 6 and 7, the device (1) according to the invention, preferably comprises a lateral partition (6) attached to each side rail (20). This lateral partition (6) preferably consists of a thin plate that extends vertically in a plane perpendicular to the front edge (5) of the shelf (3). The length of the partition (6) is preferably equal to the width of the shelf (3). A great advantage of using such partitions (6) is that they are very thin and therefore, they only occupy a negligible length of the shelf (3). Each side rail (20) preferably comprises a strip (8) on each of its lateral sides (26) to retain the partition (6) by snapping. In use, the partition (6) is fastened by snapping to the lateral side (26) of the side rail (20) which is the farthest from the central rail (30). Since the side rails (20) comprise strips (8) on each of their lateral sides (26), it is possible to place the partition (6) on either side of the side rail (20). Such makes the side rails (20) interchangeable and reduces the number of different components required to assemble the device (1).

As better illustrated on FIG. 6, the top side (32) of the central rail (30) is preferably U-shaped and empty, thereby, defining an open cavity (40) and the puller member (10) has the shape of a thin band that is sized to be inserted in the cavity (40) made on the top side (32) of the central rail (30). The backstop assembly (4) comprises a bottom section (72) which extends in the cavity (40) of the central rail (30) to be grabbed by the back end of the puller member (10) and a top section (76) which extends above the central rail (30) to come into contact with the articles (A) supported by the rails (20, 30).

Figure 10:
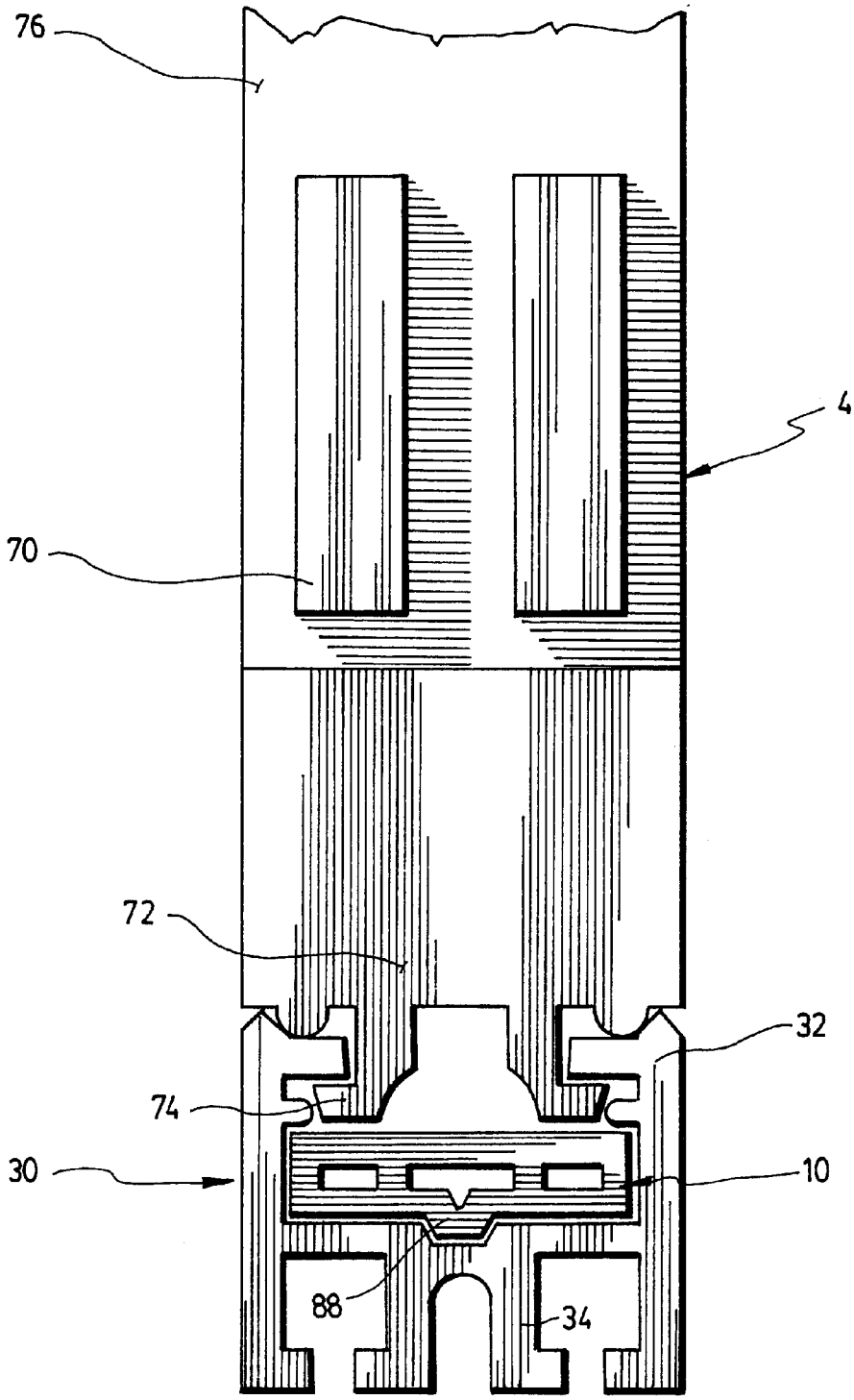
FIG. 10 is a cross-sectional front view of the central rail, comprising the puller member and the lower part of the backstop assembly extending down into the upper part of the central rail.

As illustrated in FIG. 10, the side rails (20) and the central rail (30) preferably have support grooves (44) on their top sides (22, 32), on which the articles (A) bear. The support grooves (44) permit to decrease the contact surface between the articles (A) and the top sides (22, 32) of the rails (20, 30). Thus, they permit to limit the friction and reduce premature wear and tear of the rails (20, 30).

As better illustrated in FIGS. 6 and 10, the puller member (10) has a reinforcement flange (88) on one of its flat sides, preferably on its underside. The reinforcement flange (88) permits to maintain the puller member (10) in the cavity (40) of the central rail (30). It also offers additional support to the puller member (10). The central rail (30) is profiled in such a way as to receive the reinforcement flange (88) of the puller member (10). For this purpose, the central rail (30) comprises a groove (90) on its top side (32). The cavity (40) of the central rail (30) also comprises lateral flanges used as retention means (42) for the puller member (10). The lateral flanges permit to keep the puller member (10) in place when it is slid within the cavity (40) of the rail (30). These retention means (42) offer additional stability to the puller member (10) when using the device (1).

As anyone skilled in the art will understand, the puller member may be of numerous shapes (not illustrated) as long as it remains long and thin and thus may easily penetrate inside the central rail.

Figure 11B:
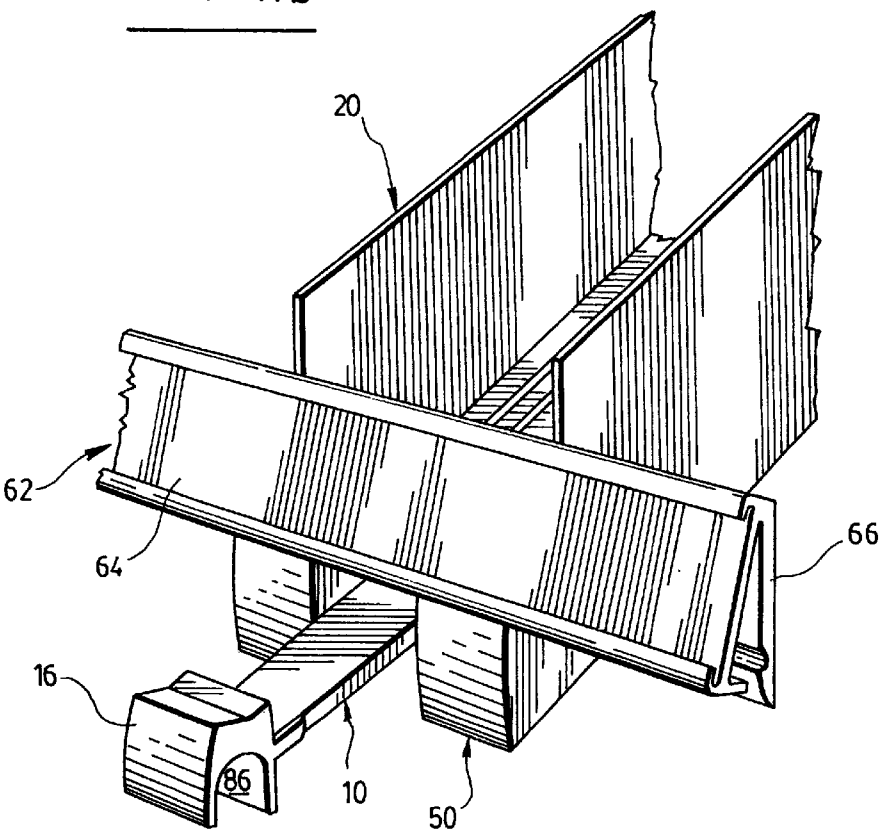
FIGS. 11*a* and 11*b* are perspective views of the front ends of the rails with the stop blocks on which the label displayer is mounted, the puller member being also shown with a handle on its front end.

As is better illustrated in FIGS. 1 and 11*b*, the puller member (10) extends outside of the central rail (30) to an adequate distance to be manually grabbed. For this purpose, the puller member (10) preferably has a handle (16) at its front end (12). The handle (16) preferably comprises lateral snaps (not shown) which are connected by snapping onto notches (also not shown) located on the sides of the puller member (10). Preferably also, the handle (16) may have a space (86) left in order to be grabbed by fingers, thereby facilitating the use of the puller member (10).

Figures 8A, 8B:
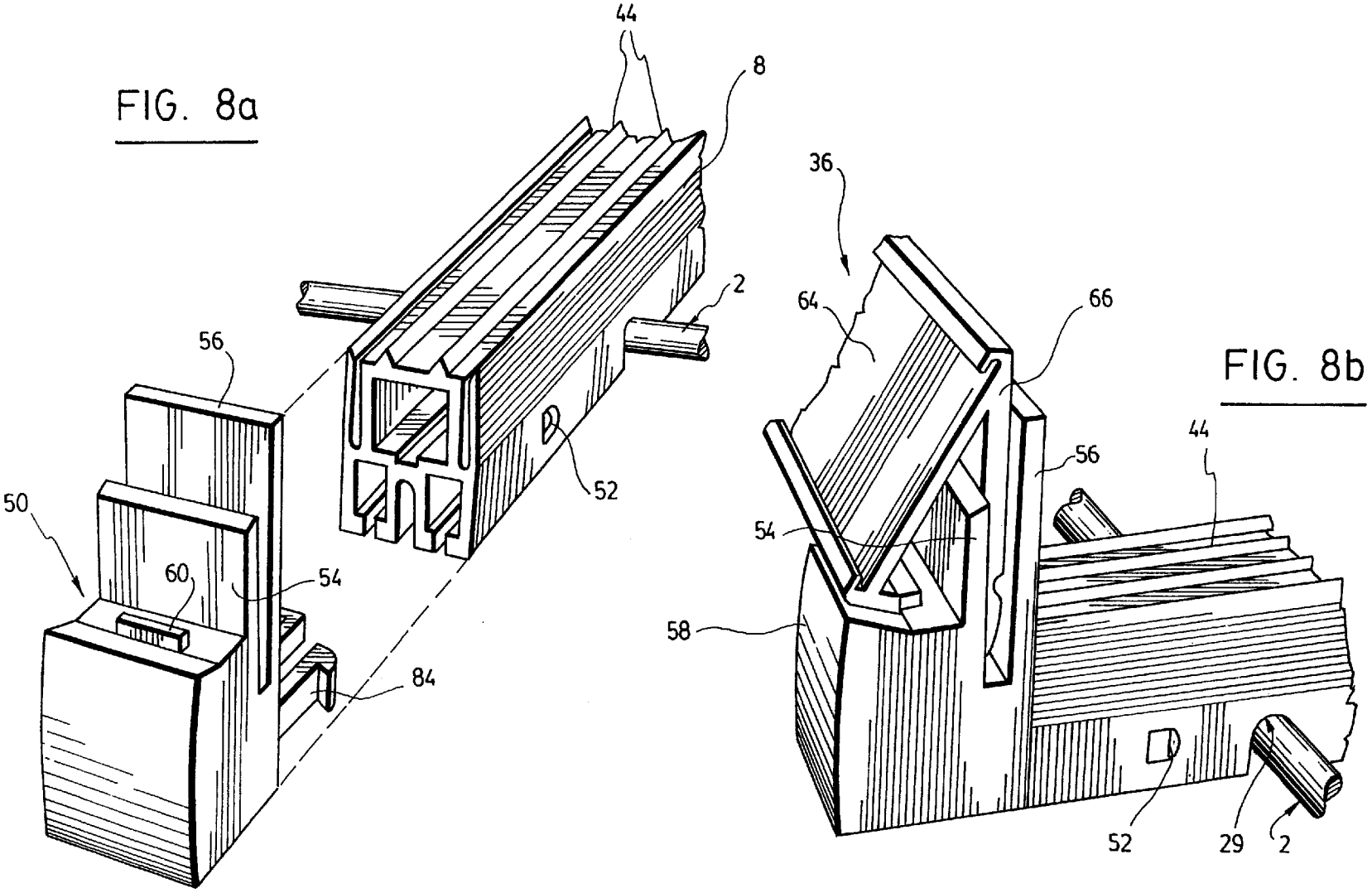
FIG. 8*a* is an exploded perspective view of a stop block attached to the front of one of the side rails.
FIG. 8*b* is a perspective view of a label displayer attached to the stop blocks attached on the rails as illustrated in FIG. 8*a*.
Figure 11A:
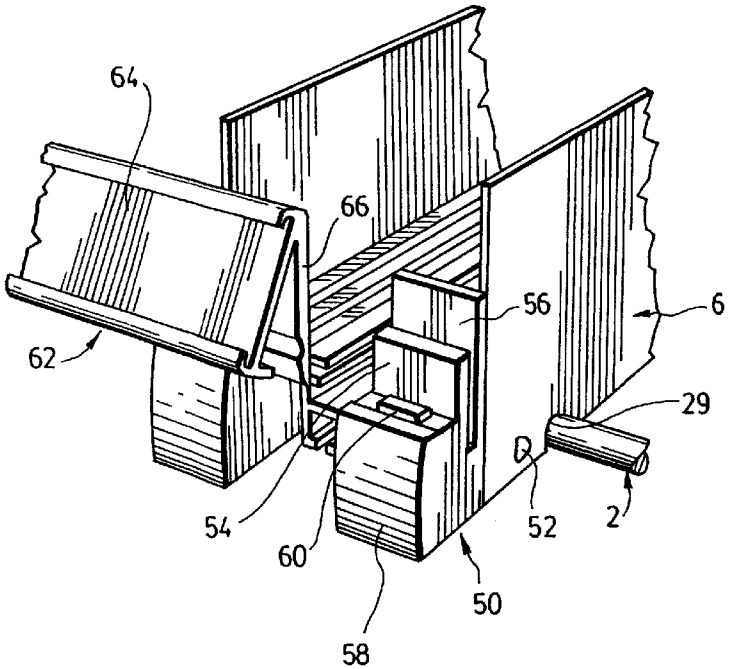

As illustrated in FIGS. 8*a*, 8*b* and 11*a*, the device (1) also preferably comprises stop blocks (50) fastened to the front end (27) of the side rails (20), for stopping articles (A) from falling when they are moved forward by the puller member (10). The stop blocks (50) preferably have lateral clamps (84) which are snapped into notches (52) located on the lateral sides (26) of the side rails (20). Such allows for the stop blocks (50) to be properly fastened to the side rails (20). The stop blocks (50) can also act as a support for any type of inscription.

As illustrated in FIGS. 11*a* and 11*b*, the device (1) according to the invention further comprises a label displayer (62) having a front face (64) and a back face (66). This label displayer (62) is intended to be connected by pressure snapping and/or sliding, to the stop blocks (50) attached to the front end (27) of the side rails (20). As is better shown in FIG. 1, the label displayer (62) is interesting inasmuch as it allows to retain the articles (A) at the front edge (5) of the shelf (3) when they are moved forward with the help of the puller member (10). The label displayer (62)

is also interesting since it allows visible display of labels on the front (64) of the articles (A) displayed on the shelf (3) as was explained previously. It is understood that the label displayer (62) may come in a variety of shapes as long as it fulfills the above-mentioned functions.

As illustrated in FIGS. 8*a*, 8*b*, 11*a* and 11*b*, the label displayer (62) is preferably connected to the stop block (50) by sliding the back face (66) of the label displayer (62) between a strip (54) positioned in front of a partition wall (56) extending vertically at the back of the stop block (50). The front face (64) of the label displayer (62) abuts against an abutment support (60) located on top of the front face (58) of the stop block (50). The label displayer (62) is thus solidly fastened on the stop block (50).

Figure 9:
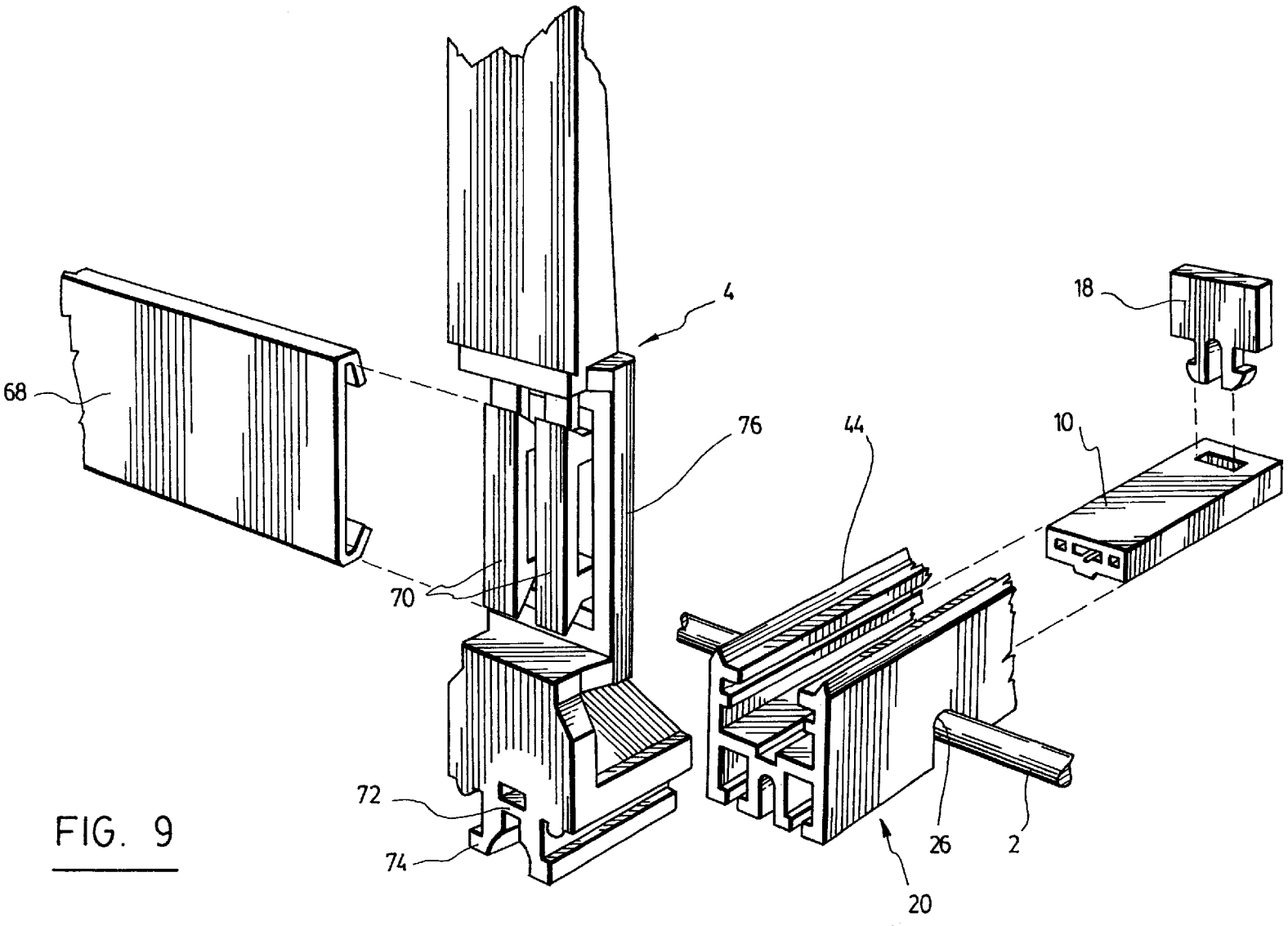
FIG. 9 is an exploded perspective view of an extension plate attachable on the backstop assembly whose bottom section is inserted in the central rail in such a way that it is in front of the back end of the puller member.

As illustrated in FIG. 9, to facilitate pulling of the backstop assembly (4) toward the front end (37) of the central rail (30), the puller member (10) may comprise a block (18) which forms an integral part of the back end (14) of the puller member (10). This block (18) may be inserted onto and protruding from the puller member (10). It is advantageously placed behind the backstop assembly (4) therefore allowing it to make contact with it and move it toward the front of the shelf (3) when the puller member (10) is pulled.

Figure 12:
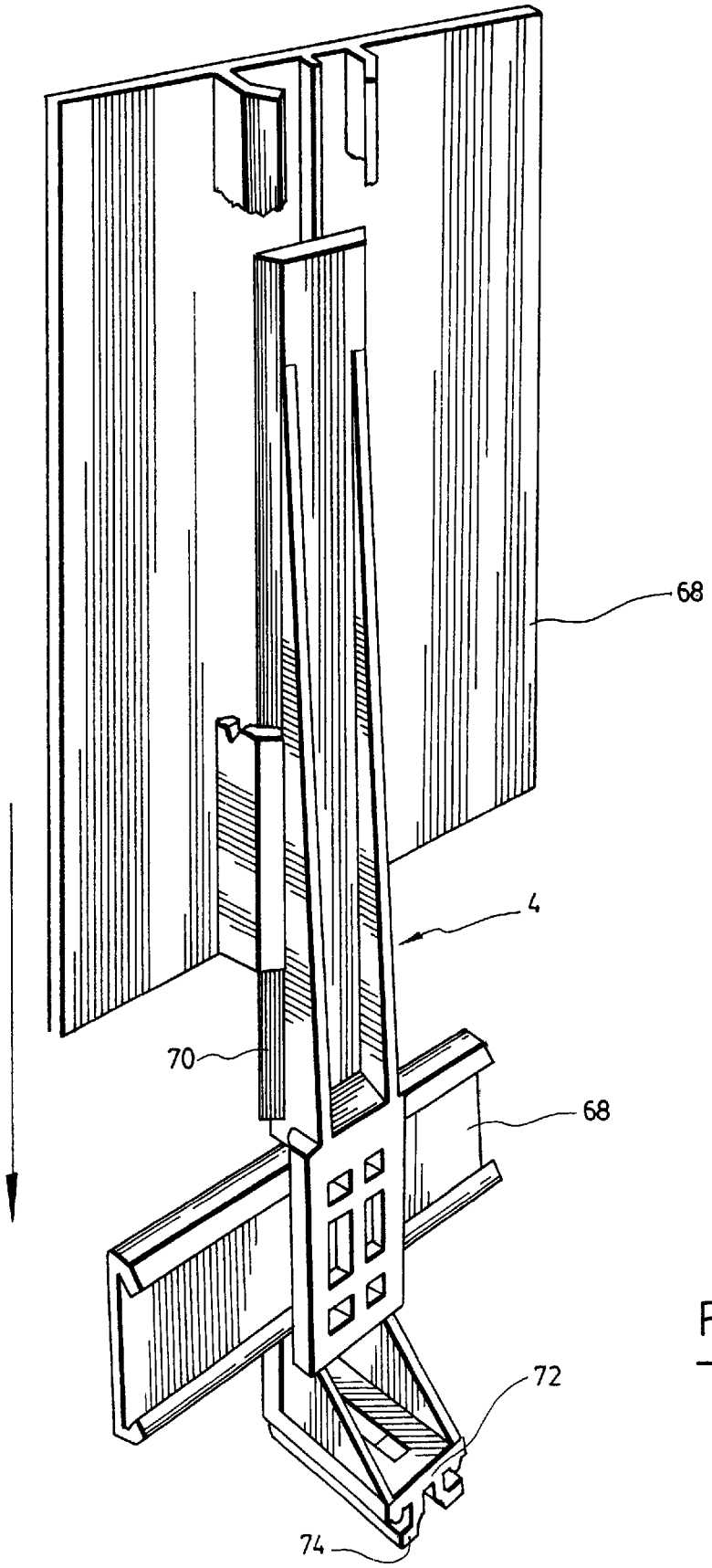
FIG. 12 is a perspective view of the back side of the backstop assembly supporting two extension plates.

As illustrated in FIGS. 9 and 12, the backstop assembly (4) preferably comprises a top section (76) which is equipped with at least one support (70) (in the illustrated embodiment, two supports), for positioning one or more extension plates (68). The extension plates (68) permit to adapt the width of the backstop assembly (4) to the size of the articles (A) placed on the shelf (3). The plates (68) are therefore chosen depending on the size of the articles (A) placed on the shelf (3). As can be seen on FIG. 10, the backstop assembly (4) comprises two support extremities (74) on its bottom section (72). These support extremities (74) penetrate inside the cavity (40) of the central rail (30) and permit to stabilize the backstop assembly (4) in the central rail (30).

Figure 4A:
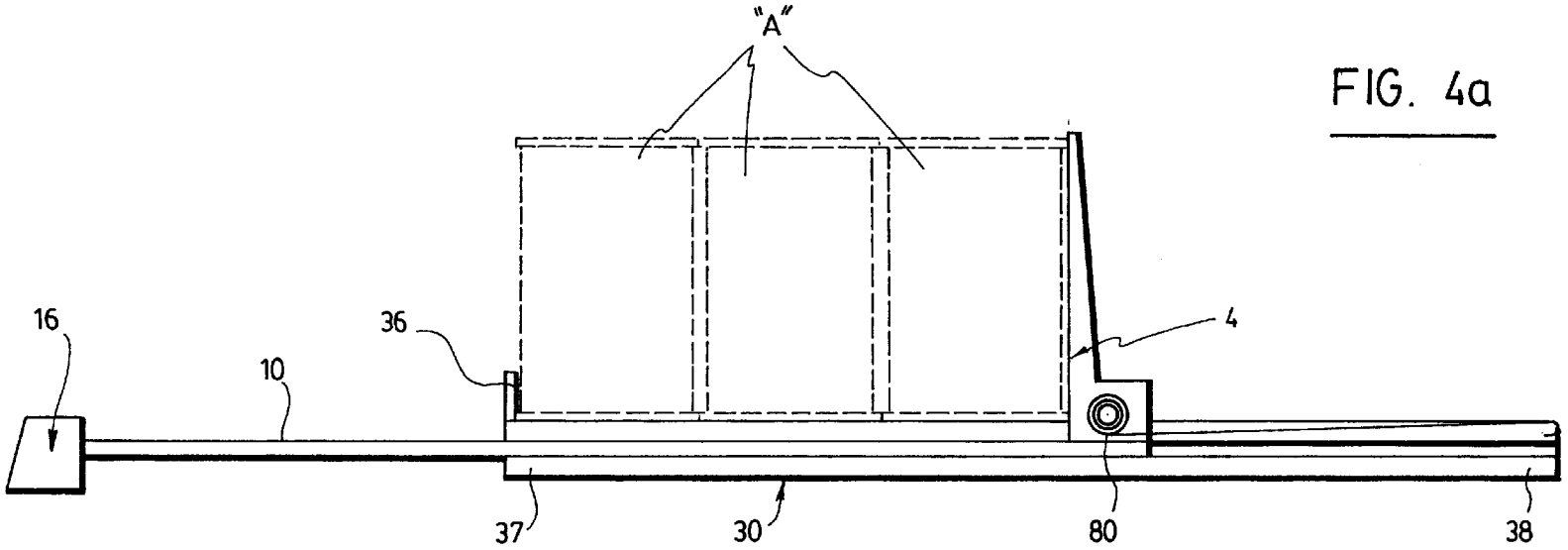
FIGS. 4*a* and 4*b* are cross-sectional side views of another embodiment of the central rail and the puller member of the device according to the invention, FIG. 4*a* showing the puller member when it is pulled forward toward the front of the shelf, FIG. 4*b* showing said puller member when it is brought back in original position, thanks to a return spring.
Figure 4B:
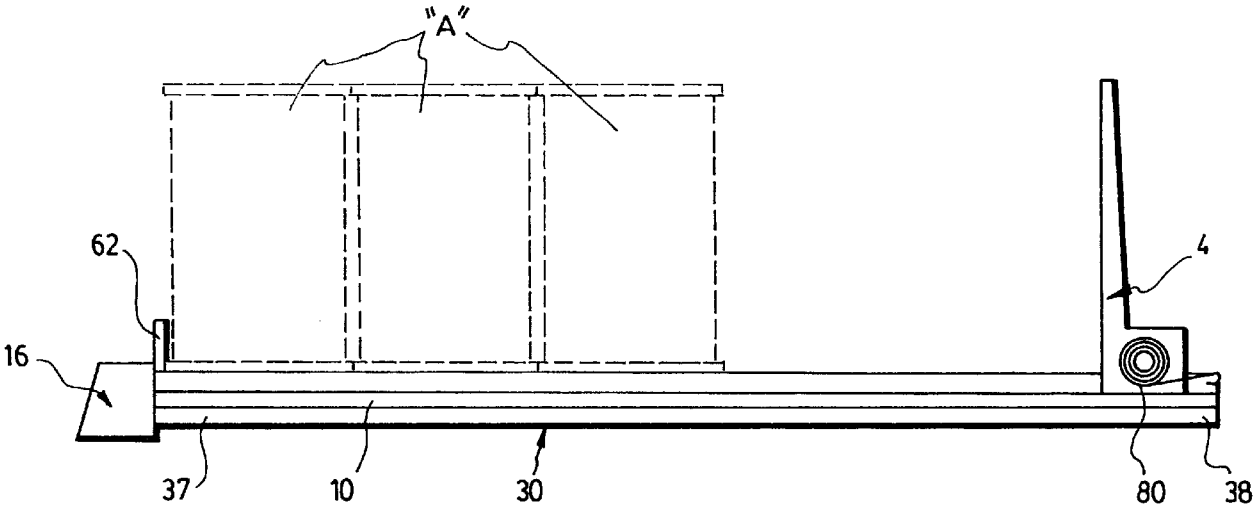

FIGS. 4*a* and 4*b* illustrate another preferred embodiment of the invention, in which the puller member (10) is connected to a spring (80) located at the back end (38) of the central rail (30). The spring (80) automatically brings the puller member (10) to the back end (38) of the central rail (30) after the puller member (10) has been pulled forward toward the front edge (15) of the shelf (3).

Figure 5A:
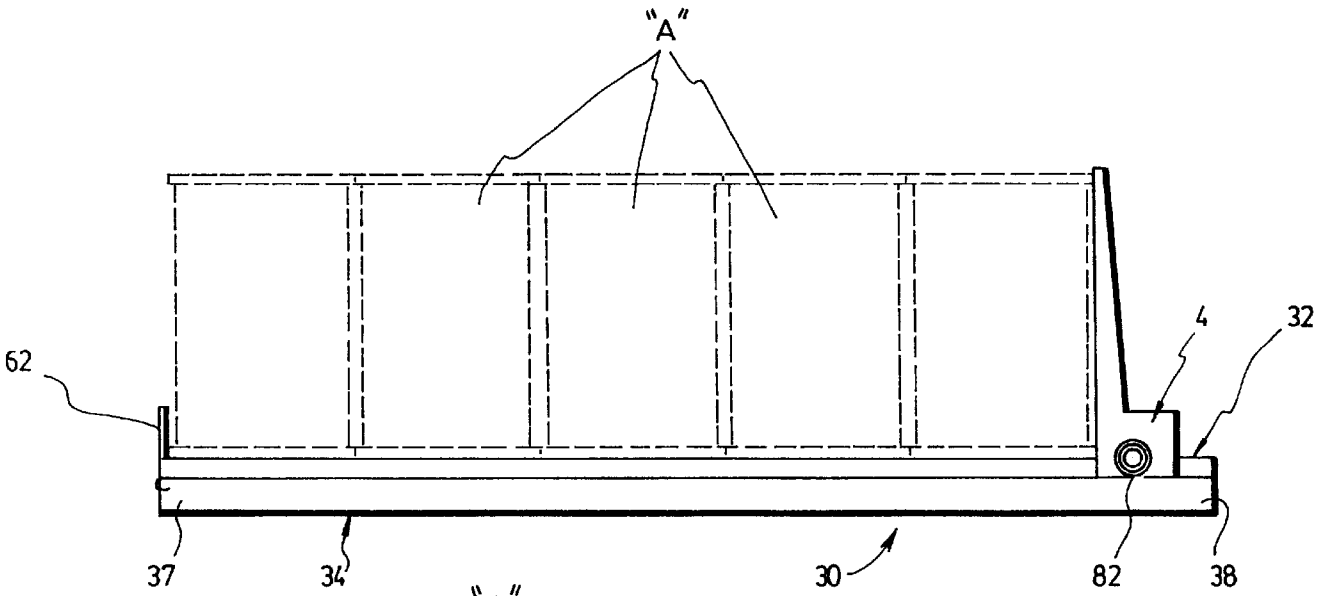
FIGS. 5*a* and 5*b* are cross-sectional side views of another embodiment of the central rail and the puller member of the device according to the invention, wherein the backstop assembly moves forward the articles toward the front of the shelf with the help of a spring, FIG. 5*b* showing the position of the backstop assembly after removal of some articles.
Figure 5B:
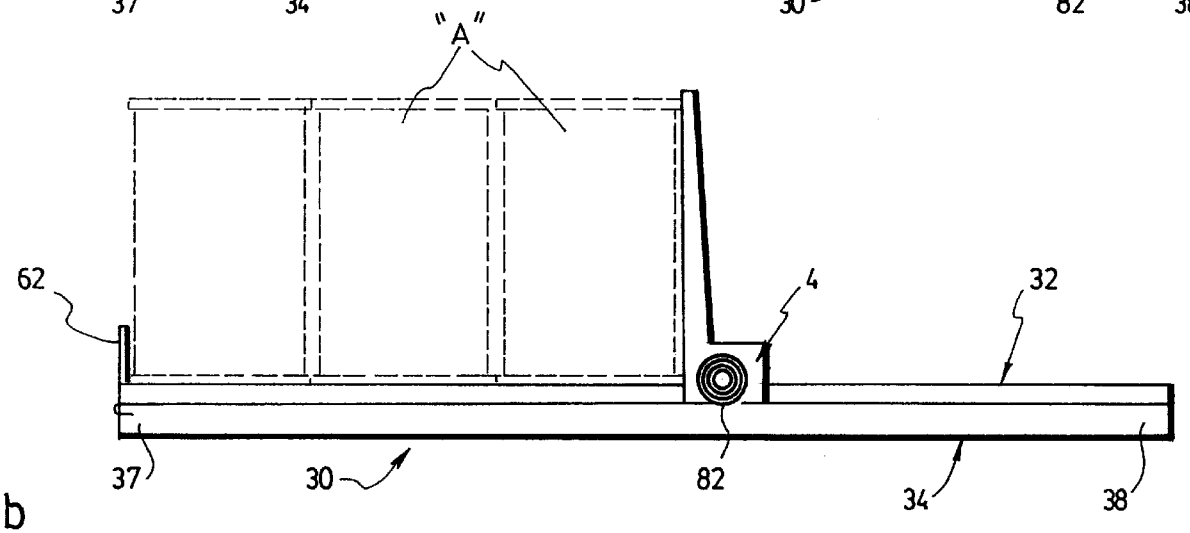

FIGS. 5*a* and 5*b* illustrate a further preferred embodiment of the invention. In this preferred embodiment, the puller member comprises a spring (82) fastened on the backstop assembly (4) and to the front end (37) of the central rail (30). The spring (82) automatically moves the remaining articles (A) toward the front of the shelf (3) when one or more of the articles (A) are taken off the shelf (3).

In both of these other preferred embodiments of the invention, the side rails (20), the central rail (30), the rods (2) and the partitions (6) are essentially identical to what has been described previously.

The structural components of the device (1) according to the invention described as such previously, can be made of any type of material. Preferably, one will use a plastic material which is already used in the manufacturing of display devices for stores, as is obvious for someone skilled in the art. More preferably, use will be made of polystyrene.

Of course, numerous changes and modifications could be made to what is disclosed hereinabove without departing from the scope and spirit of the invention as expressed in the claims appended hereto.

What is claimed is:

1. A device for moving forward in a simple and efficient manner articles of a given dimension placed on a shelf having a front edge in order to facilitate frontal display of said articles, the device comprising:

positioning means installed on the shelf in such a way as to extend in parallel relationship with respect to the front edge of said shelf, said positioning means comprising at least one rod installed on the shelf in parallel relationship with respect to the front edge of said shelf;

two side rails acting as a support for the articles, each of said side rails comprising:

a top side;

a bottom side;

two lateral sides;

a front end;

a back end; and fastening means for connecting said side rail onto the positioning means at any distance away from the other side rail depending on the size of the articles;

said side rails once installed extending in parallel relationship perpendicularly to the front edge of the shelf;

a central rail comprising;

a top side;

a bottom side;

two lateral sides;

a front end;

a back end; and fastening means for connecting said central rail on said positioning means between the two side rails in parallel relationship with respect thereto;

a backstop assembly mounted in such a way as to slide on the central rail, said backstop assembly extending vertically in order to come into contact with the articles supported on the side rails; and a puller member mounted on the central rail in such a way as to extend in parallel relationship with respect to the side rails, said puller member allowing, when the articles stay on the side rails in front of the backstop assembly, to displace the backstop assembly toward the front end of the central rail and thus move forward the articles closer to the front edge of the shelf.

2. The device as claimed in claim 1, wherein said fastening means comprise notches located on the lateral sides of the side and central rails, said notches are shaped and sized to allow connection of said side and central rails to said at least one rod by snapping.

3. The device as claimed in claim 2, wherein said positioning means comprise two of said at least one rod that are installed on the shelf in parallel relationship with respect to the front edge of said shelf.

4. The device as claimed in claim 3, further comprising a partition attached to each side rail, said partition extending vertically in a plane perpendicular to the front edge of said shelf.

5. The device as claimed in claim 4, wherein said partition is attached to the lateral side of the side rail which is the farthest from the central rail.

6. The device as claimed in claim 5, wherein each side rail further comprises a strip on each of its lateral sides to allow attachment of the partition by snapping.

7. The device as claimed in claim 6, further comprising stop blocks fastened to the front ends of the side rails.

8. The device as claimed in claim 7, further comprising a label displayer connected by snapping onto the stop blocks fastened to the front ends of the side rails, said label displayer extending perpendicularly to the side rails and thus retaining the articles at the front edge of the shelf while allowing visible display of a commercial advertisement.

9. The device as claimed in claim 8, wherein the top side of the central rail is U-shaped and empty;

the puller member has a front end and a back end and is positioned inside the central rail; and the backstop assembly comprises a bottom section extending inside the central rail in such a way as to be grabbed by the back end of the puller member, and a top section extending above said central rail to come into contact with the articles supported by the side rails.

10. The device as claimed in claim 9, wherein the top section of the backstop assembly comprises at least one support for positioning at least one extension plate of a dimension chosen as a function of the dimension of the articles.

11. The device as claimed in claim 9, wherein said puller member is in the form of a thin, rigid band slidably mounted inside the central rail, and the front end of the puller member extends out of the central rail in such a way as to be manually grabbed.

12. The device as claimed in claim 11, wherein the puller member further comprises a handle at the front end of the band to facilitate its grabbing.

13. The device as claimed in claim 12, wherein the puller member further comprises a block that is an integral part of its back end, said block being located behind the bottom section of the backstop assembly in order to grab and pull the latter toward the front edge of the shelf when said puller member is grabbed and pulled.

14. The device as claimed in claim 13, wherein the back end of the puller member is connected to a spring fastened at the back end of the central rail to automatically bring back the puller member to the back end of said central rail after said puller member has been pulled forward.

15. The device as claimed in claim 9, wherein said puller member consists of a spring having a first end connected to the front end of the central rail and a second end connected to the backstop assembly, said spring allowing the backstop assembly to automatically bring forward the articles toward the front edge of the shelf when one or more articles displayed in front have been taken off the shelf.

16. The device as claimed in claim 13, which is made of plastic material.

17. The device as claimed in claim 16, wherein said plastic is polystyrene.

18. The device as claimed in claim 2, wherein:

the top side of the central rail is U-shaped and empty;

the puller member has a front end and a back end and is positioned inside the central rail;

the backstop assembly comprises a bottom section extending inside the central rail in such a way as to be grabbed by the back end of the puller member, and a top section extending above said central rail to come into contact with the articles supported by the side rails;

said puller member is in the form of a thin, rigid band slidably mounted inside the central rail; and the front end of the puller member extends out of the central rail in such a way as to be manually grabbed.

19. The device as claimed in claim 18, which is made of plastic material.

* * * * *